United States Patent [19]

Carriere

[11] 4,368,600

[45] Jan. 18, 1983

[54] REMOVABLE GUTTERING ASSEMBLY FOR MAN-HOLES OR THE LIKE

[76] Inventor: Yvon Carriere, 73, Huneault St., Pincourt, Quebec, Canada, J7V 7C3

[21] Appl. No.: 196,059

[22] Filed: Oct. 10, 1980

[30] Foreign Application Priority Data

Oct. 31, 1979 [CA] Canada ..... 338839

[51] Int. Cl.[3] ..... E02D 29/14

[52] U.S. Cl. ..... 52/11; 52/20; 404/25

[58] Field of Search ..... 52/11, 16, 19, 20; 404/25; 137/363

[56] References Cited

U.S. PATENT DOCUMENTS

| | | | |
|---|---|---|---|
| 374,458 | 12/1887 | Davis . | |
| 606,554 | 6/1898 | Jacobs . | |
| 826,746 | 7/1906 | Priddle . | |
| 848,900 | 4/1907 | Hammerstein . | |
| 2,004,335 | 6/1935 | Merriman . | |
| 3,973,856 | 8/1976 | Gaglioti | 404/25 |
| 4,136,010 | 1/1979 | Pilié et al. | 52/20 X |

OTHER PUBLICATIONS

Mining Engineers Handbook, John Wiley & Sons Inc., 1945, pp. 7–13.

*Primary Examiner*—Price C. Faw, Jr.
*Assistant Examiner*—Carl D. Friedman
*Attorney, Agent, or Firm*—Bacon & Thomas

[57] ABSTRACT

A removable guttering assembly is disclosed for use in man-holes or air shafts to improve working conditions and to reduce the risk of water damage to equipment located in these holes or shafts. The guttering assembly consists of hooks or rails mounted around the lower end of the hole or shaft and a removable gutter, having substantially the same size as the perimeter of the lower end of the hole or shaft, which is quickly and easily attached to the hooks or rails. When fixed in position, the gutter collects water which enters the hole or shaft and directs it into a drain pipe preventing it from contacting men or equipment located in the hole or shaft.

5 Claims, 5 Drawing Figures

REMOVABLE GUTTERING ASSEMBLY FOR MAN-HOLES OR THE LIKE

FIELD OF THE INVENTION

The present invention relates to a removable guttering assembly for man-holes, ventilation-holes, or air-shafts such as those used by the electric power, gas or telephone companies.

BACKGROUND OF THE INVENTION

Man-holes or air-shafts used by the public utilities, such as the telephone, power or gas companies, have collars of variable lengths and diameters. These holes or shafts are generally made of masonry or concrete and, independently of their length of service or location, their main drawback is cracks extending along the internal walls of their collars or under the lower ends thereof. These cracks, which are caused by the infiltration of rain, the erosion of the ground and/or the frost in winter, allow water to infiltrate around the collar and enter the man-hole. Of course, the water streams down inside the galleries and wets the main walking or working areas as well as the equipment that is located therein. Where electrical equipment is involved, the risk of injury due to short circuits and fires is very great.

SUMMARY OF THE INVENTION

The object of the present invention is to provide a removable guttering assembly which overcomes the above mentioned drawback, without reducing the capacity or utilization of the holes or shafts in any way.

The removable guttering assembly according to the invention comprises attaching means permanently mounted adjacent to the lower end of the hole or shaft and a removable gutter having substantially the same size as the lower end of the hole or shaft, having laterally extending flange that is quickly and easily inserted into the attaching means. When fixed in position, this gutter collects the water which enters the hole or shaft, thus avoiding the dangers to men or equipment located below. The guttering assembly further comprises at least one drain tube fixed to the removable gutter for draining the collected water towards the ground.

In accordance with a preferred embodiment of the invention, the attaching means constitute a plurality of hooks located at spaced, circumferential points around the lower end of the hole or shaft. The hooks receive the lateral flange of the gutter by mere insertion to hold the gutter in place.

In accordance with another preferred embodiment of the invention, the attaching means constitute a pair of parallel rails on either side of the lower end of the hole or shaft. The rails are adapted to receive the lateral flange of the gutter and to guide the same from a retracted position to an operative position where the gutter is located just under the hole or shaft, and vice-versa.

The removable guttering assembly according to the invention is particularly useful not only because it prevents the infiltration of water, but also because it is easily removable to allow men or equipment to enter the hole or shaft.

BRIEF DESCRIPTION OF THE DRAWINGS

The invention will be better understood with the reference to the following non-restrictive description taken in connection with the accompanying drawings in which.

DETAILED DESCRIPTION OF THE PREFERRED EMBODIMENTS

Figure 1:
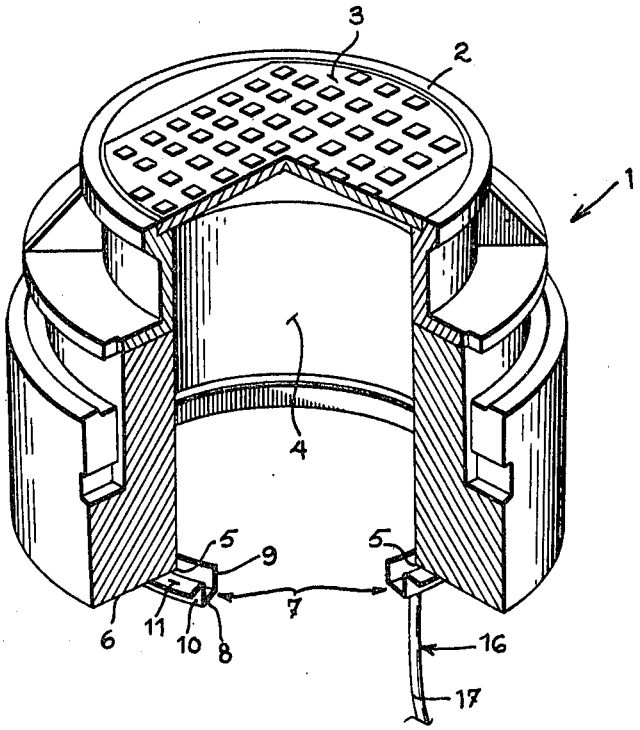
FIG. 1 is a perspective, partial cross-sectional view of a man-hole provided with a removable guttering assembly according to the invention.

The removable guttering assembly illustrated on the accompanying drawings is intended to be used under a man-hole (or ventilation shaft) 1 having a conventional construction comprising an upper end 2 that is closed by removable plate 3, an inside wall 4 of circular or square cross-section, and a lower end 6 that forms part of the top of a gallery or cavity into which the man-hole 1 opens.

As already indicated, the object of the removable guttering assembly of this invention is to collect the water which enters the hole 1 and runs along the inner wall 4 thereof, and thus avoid the inherent dangers associated with the water coming into contact with men or various types of equipment installed in the gallery.

For this purpose, the removable guttering assembly comprises gutter 7 having a generally U-shaped cross-section, with bottom wall 8 and two lateral walls 9 and 10. Gutter 7 is shaped so as to have substantially the same size and perimeter as the lower end 6 of the hole 1. Accordingly, if the hole 1 is of circular cross-section, gutter 7 will also be circular. On the contrary, if the hole 1 is of square cross-section, gutter 7 will also be square.

The dimensions of lateral walls 9 and 10 of gutter 7 are so chosen that the corner 5, located at the juncture of inside wall 4 and lower end 6 of the hole, is located just above the middle of bottom wall 8. Thus, for example, if inside wall 4 of a circular man-hole 1 has a standard diameter of about 75 cm., gutter 7 will have an internal diameter, as defined by wall 9, of about 72 cm and an external diameter, as defined by wall 10, of about 78 cm, such corresponding to a gutter having a width of about 3 cm.

Removable gutter 7 is preferably made of slightly deformable plastic material or nylon having a bright color so as to be readily visible inside the cavity.

Figure 2:
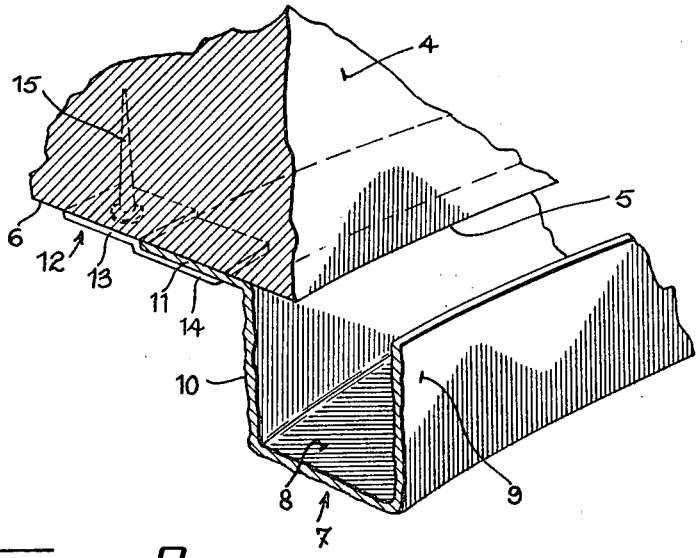
FIG. 2 is an enlarged perspective cross-sectional view of a first embodiment of the invention of FIG. 1.

According to a first embodiment of the invention illustrated in FIG. 2, gutter 7 can be removably attached under lower end 6 of hole 1 by means of a plurality of hooks 12 located at spaced points around the periphery of lower end 6. Each hook comprises a first flat surface 13 that is fixed flat to the surface of lower end 6 with a nail, a screw or a staple 15. Obviously, any other means may be used to fasten hook 12 in place. Each hook 12 also comprises a second flat surface 14 extending in a plane located at a lower position with respect to the plane in which surface 13 extends so as to create a gap between lower end 6 and surface 14. This gap receives and holds a laterally extending flange 11 integrally formed with or attached to an upper edge of lateral wall 10.

When flange 11 is inserted into the gap defined by each hook 12, gutter 7 is held just under corner 5 and thus can collect the water which enters hole 1 and runs down along inner wall 4. The water collected in gutter 7 is drained towards the ground through one or more drains 16. Drains 16 may be a tube 17 of rubber or plastic material having a variable length ranging between about 1 to 3 m, and fixed to one or more openings 18 in bottom wall 8 of gutter 7.

One of the main advantages of the above described guttering assembly is that the gutter 7 is easily removable. Actually, gutter 7 can be installed in a few seconds by mere compression towards its center to permit flange 11 to engage hooks 12. This characteristic is of particular interest since it allows men and equipment to pass through the hole without damaging the gutter assembly. At the same time, the rapid installation thereof allows the same men and equipment to be protected against water or melted snow streaming down along the inside wall 4 of the hole 1.

It should be noted that gutter 7 is of a substantially small size as compared to the size of the hole 1. The installation of gutter 7 thus does not involve removal of a ladder which may be located inside the collar of the hole, nor of the electric cables that pass through to supply electric power for lamps, pumps or other equipment. The material used for the gutter is very light and flexible, thereby presenting no danger to personnel working in the gallery.

Figure 3:
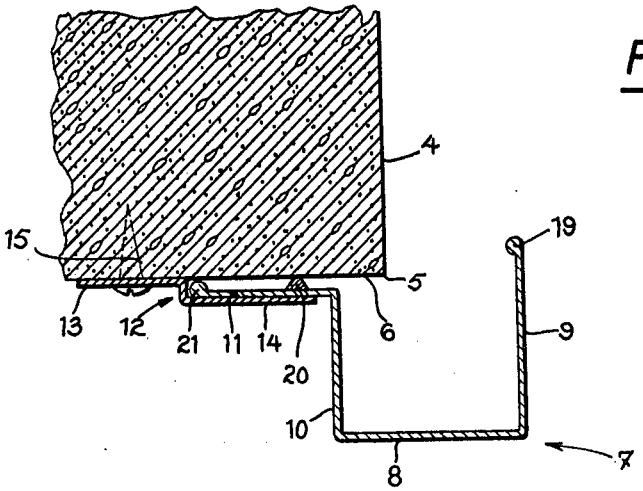
FIG. 3 is a cross-sectional side view of a first alternative embodiment of the guttering assembly according to the invention.

In actual practice, not only is the inside wall 4 cracked and fissured, but also the surface of the lower end 6 of the hole 1. This allows water to run a few inches along the surface of the ceiling of the cavity before streaming down therein. In order to avoid this drawback, a molding 20 may be fixed onto the super surface of flange 11 as shown in FIG. 3. The thickness of molding 20, which can be made of plastic or foam, must be chosen such that its upper end comes into contact with the surface of the ceiling surrounding the lower end 6 of the hole 1. Thus, water running down along the inner wall 4 of the hole cannot run along the surface surrounding the lower end 6 because it is directed by the molding 20 towards gutter 7.

It should be noted that if much water enters the hole along the inner wall 4, as is often the case at thaw or in very rainy regions, it would be necessary to use a plurality of draining tubes 17 to avoid overflowing of gutter 7.

It should also be noted that beads 19 and 21 can be formed on the free edges of inside wall 9 and lateral flange 11 if desired.

In order to facilitate storing of the gutter 7 when not in use, a chain having a length of about 30 cm, can be attached to the ceiling of the cavity by any conventional means and be used for hanging the gutter up when removed from its attaching hooks. This method of storing the gutter avoids placing it on the floor of the cavity where it is subject to damage.

Figure 4:
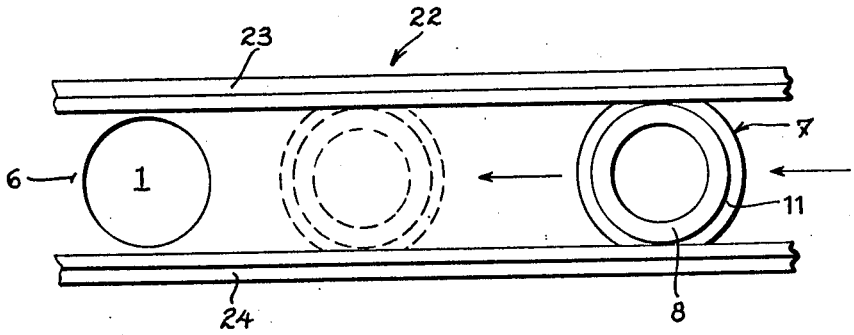
FIG. 4 is a bottom plan view of a second alternative embodiment of the removable gutter according to the invention.
Figure 5:
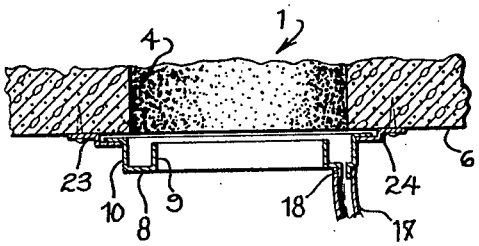
FIG. 5 is a cross-sectional side view of the embodiment shown in FIG. 4.

According to another embodiment of the invention, gutter 7 can be attached to the ceiling of the cavity by attaching means 22 comprising a pair of parallel rails 23 and 24 passing on either side of the opening in lower end 6 as illustrated in FIGS. 4 and 5. Rails 23 and 24 are shaped and positioned in such a manner that they can slidably receive flange 11 of gutter 7. The rails serve to guide the gutter from a retracted position to an operative position where it is located just under the hole, or vice versa.

This embodiment is of a particular interest when the cavity into which the hole opens, is deep (more than 2 m). Indeed, it is much easier for a man working inside the cavity or passing through the hole, to pull gutter 7 toward him and to place it in operative position rather than inserting the same into the hooks such as illustrated on FIG. 3.

The foregoing description is for illustrative purposes only and should not be construed as limiting this invention, the scope of which is determined by the attached claims.

I claim:

1. A removable guttering assembly for use in a manhole ventilation shaft or the like comprising:

a. attaching means comprising a plurality of hooks located at spaced apart points around the periphery of a lower end of the hole or shaft in such a manner that they can receive a lateral flange of a removable gutter by mere insertion of the same therein;

b. a removable gutter having substantially the same size and shape as the lower end of the hole or shaft for collecting water entering said hole or shaft, said gutter having a laterally extending flange that can be quickly and easily engaged with said attaching means; and c. at least one draining tube attached to said removable gutter for draining the water collected therein toward the ground.

2. A removable guttering assembly for use in a manhole ventilation shaft or the like, comprising:

(a) attaching means comprising a pair of parallel rails located on either side of the lower end of the hole or shaft, said rails being adapted to slidably receive a lateral flange of a gutter so as to guide the same from a retracted position to an operative position where the gutter is located just under the hole or shaft;

(b) a gutter having substantially the same size and shape as the lower end of the hole or shaft for collecting water entering said hole or shaft, said gutter having a laterally extending flange that can be quickly and easily engaged with said attaching means; and (c) at least one draining tube attached to said removable gutter for draining the water collected therein toward the ground.

3. A removable guttering assembly as claimed in claim 1, or 2, wherein the gutter and each draining tube are made of a plastic material.

4. A removable guttering assembly as claimed in claim 1, or 2, further comprising a molding extending upwardly from an upper surface of the lateral flange of the gutter all around the same, said molding being in contact with the surface of the lower end of the hole or shaft to direct the water running thereon towards the gutter.

5. A removable guttering assembly for use in a manhole ventilation shaft or the like comprising:

(a) attaching means mounted adjacent to a lower end of the hole or shaft;

(b) a removable gutter having substantially the same size and shape as the lower end of the hole or shaft for collecting water entering said hole or shaft, said gutter having a laterally extending flange that can be quickly and easily engaged with said attaching means;

(c) at least one draining tube attached to said removable gutter for draining the water collected therein toward the ground; and (d) a molding extending upwardly from an upper surface of the lateral flange of the gutter all around the same, said molding being in contact with the surface of the lower end of the hole or shaft to direct the water running thereon towards the gutter.

* * * * *